United States Patent [19]

Elliott

[11] Patent Number: 4,640,422

[45] Date of Patent: Feb. 3, 1987

[54] KNUCKLE STRUCTURE TO PREVENT KNUCKLE PIN FAILURE IN A RAILWAY COUPLER

[75] Inventor: William O. Elliott, Pittsburgh, Pa.

[73] Assignee: McConway & Torley Corporation, Pittsburgh, Pa.

[21] Appl. No.: 698,782

[22] Filed: Feb. 6, 1985

[51] Int. Cl.[4] ..... B61G 3/04

[52] U.S. Cl. ..... 213/155

[58] Field of Search ..... 213/64, 69, 155, 152

[56] References Cited

U.S. PATENT DOCUMENTS

Re. 23,796 3/1954 Metzger ..... 213/155
1,075,426 10/1913 Janney ..... 213/155
2,250,920 7/1941 Van Dorn ..... 213/64
3,640,402 2/1972 Altherr et al. ..... 213/69 X

*Primary Examiner*—Randolph A. Reese
*Assistant Examiner*—David F. Hubbuch
*Attorney, Agent, or Firm*—Thomas H. Murray; Clifford A. Poff

[57] ABSTRACT

A knuckle for a railway coupler in which an annular knuckle pin support wall is located between upper and lower knuckle pin holes. The knuckle pin support wall in one embodiment is an annular rib and in another embodiment, a continuous wall is formed between knuckle pin holes to prevent fatigue fracture of the pin due to bending fatigue.

6 Claims, 6 Drawing Figures

KNUCKLE STRUCTURE TO PREVENT KNUCKLE PIN FAILURE IN A RAILWAY COUPLER

BACKGROUND OF THE INVENTION

This invention relates to improvements in a railway coupler for withstanding repetitive stress loadings on parts thereof, and more particularly to an improved knuckle construction to avoid knuckle pin failure, particularly due to bending loads by supporting the pin within the knuckle in a manner that prevents bending moments that cause the knuckle pin to fail because of fatigue fracture.

In conventional railway couplers, coupling of cars is accomplished by means of interlocking knuckles which can be either in compression or tension, depending upon the direction of movement of a train. When movement of the train reverses, and the knuckles change from a tension condition to a compression condition, the nose of each knuckle tends to slam into the throat portion of the other. After a period of time, this results in a metal fatigue condition with attendant cracks in the throat region of the knuckle. Complex and repetitive stress loadings on the coupler, particularly the knuckle pin thereof, cause fatigue fracturing due to bending loads on the pin. The bending loads are imposed on the knuckle pin upon movement of a train from a stop condition as well as when the train reverses direction from a buff condition to a draft condition. Other conditions occur during the use of railway couplers that bring about repetitive stress loadings as either a static and/or dynamic loading on the knuckle pin. These conditions include movement of a train over vertical track level variations; a rocking and rolling of the car body; and rotation of a railway car for dumping while coupled to other cars by interlocking couplers constructed to accommodate rotary movement between the cars. These conditions exist irrespective of whether standard AAR F-type couplers or E-type couplers are used. Moreover, in an E-type coupler, the nose portion of one knuckle can slide vertically through a distance of about one-half the knuckle height of the mating coupler. As is well known in the art, an E-type coupler does not include interlocking lugs and aligning wing pockets which are predominant features of F-type coupler heads. In F-type couplers, the interlocking lugs prevent vertical sliding of one knuckle relative to a mating knuckle. Because of this interlocking feature of F-type coupler heads, they are usually selected to embody a construction to permit rotation of a car while coupled to another car. Failure of a knuckle pin due to fatigue fracture is not always detected when the fracture occurs because sometimes parts of the fractured pin remain in place; thus, permitting rotation of the knuckle on the coupler head. An unsafe condition does, however, exist because the fractured pin parts can fall from the coupler. Frequently, part of a fractured pin falls out of a coupler of a car when the car is rotated for dumping.

Fatigue failure of knuckle pins usually only occurs when the coupler and knuckle surfaces which are load bearing become worn or experience unusual service conditions. Sometimes, however, a knuckle pin in a new coupler can be stressed beyond the elastic limit of the material of the pin. The present invention is based on the surprising discovery that by supporting at least the midportion of the knuckle pin against bending in a direction transverse to the pin length will prevent pin failure, particularly due to fatigue fracture in all known couplers. Sometimes, in the past, knuckles of couplers were strengthened in the throat area by modification to a core used in a casting to produce upper and lower circular openings which are seperated by an intermediate cavity of larger cross-sectional area than the circular openings. The wall between the outer surface of the throat and the inner surface of the cavity had an increased thickness at the center of the pivot pin hole to reinforce the outer surface of the throat portion against cracking caused by fatigue due to repeated engagement with the nose portion of a mating knuckle. An example of this knuckle construction can be found in Canadian Pat. No. 540837. Other forms of reinforcement for the throat and inner surface of the cavity were provided by forming an annular collar in the core area at about the midportion between the top and bottom pin hole openings in the knuckle. Sometimes, instead of an annular collar, the core area was eliminated so that the pin extended through an enlarged hole in an otherwise solid knuckle. The dimensional relationship between the parts was such, however, that the knuckle pin was unrestrained against bending transverse to its length within dimensional limits sufficient to prevent fatigue failure of the knuckle pin.

SUMMARY OF THE INVENTION

It is an object of the present invention to provide an improved knuckle structure for a railway coupler that will solve the problem of knuckle pin failures as hereinbefore identified.

It is a further object of the present invention to provide an improved knuckle structure to materially reduce or eliminate fatigue cracks in a knuckle pin by supporting at least a part of the knuckle pin along its length between the top and bottom pin support walls of the knuckle.

In accordance with the present invention, the problems associated with metal fatigue of a knuckle pin used to pivotally interconnect a knuckle with a coupler head for a railway car are materially reduced or eliminated by forming a pin-support surface between top and bottom hub sections of the knuckle to engage and prevent or at least minimize deflection of the pin sufficiently against bending and thereby provide resistance against high magnitudes of repetitive bending stress loadings which cause fracturing of the pin material due to fatigue.

The pin-support surface of the present invention can be an annular rib projecting in a core area of the knuckle about miday between the top and bottom pin support walls of the knuckle. A continuous pin-support wall can be provided along the height of the knuckle with the pin-receiving opening in the wall dimensioned to restrain the pin against lateral bending. When less than a continuous pin-support wall is provided in the knuckle castings, it is preferred to dimension the size of the pin-receiving hole at the top and bottom for a metal-to-metal fit with the knuckle pin.

The above and other objects and features of the invention will become apparent from the following detailed description taken in connection with the accompanying drawings which form a part of this specification, and in which.

Figure 1:
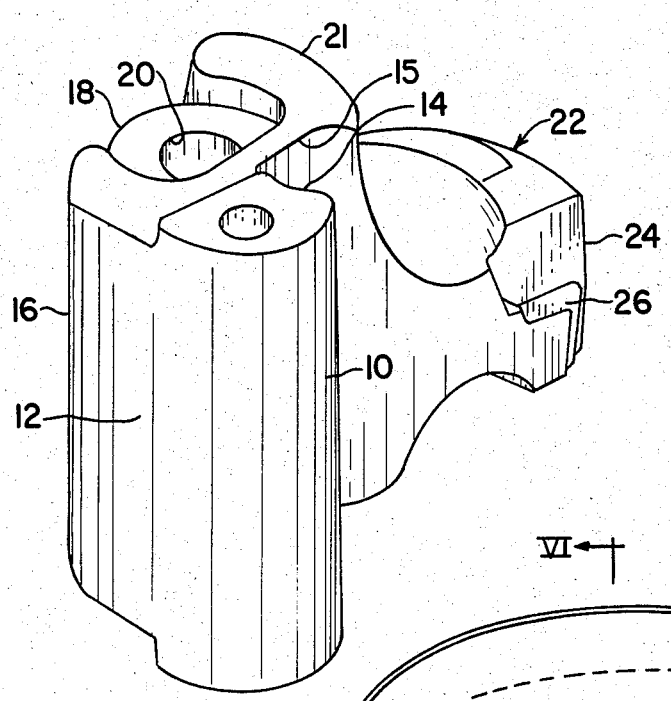
FIG. 1 is a perspective view of a railway coupler knuckle into which the present invention may be incorporated.
Figure 2:
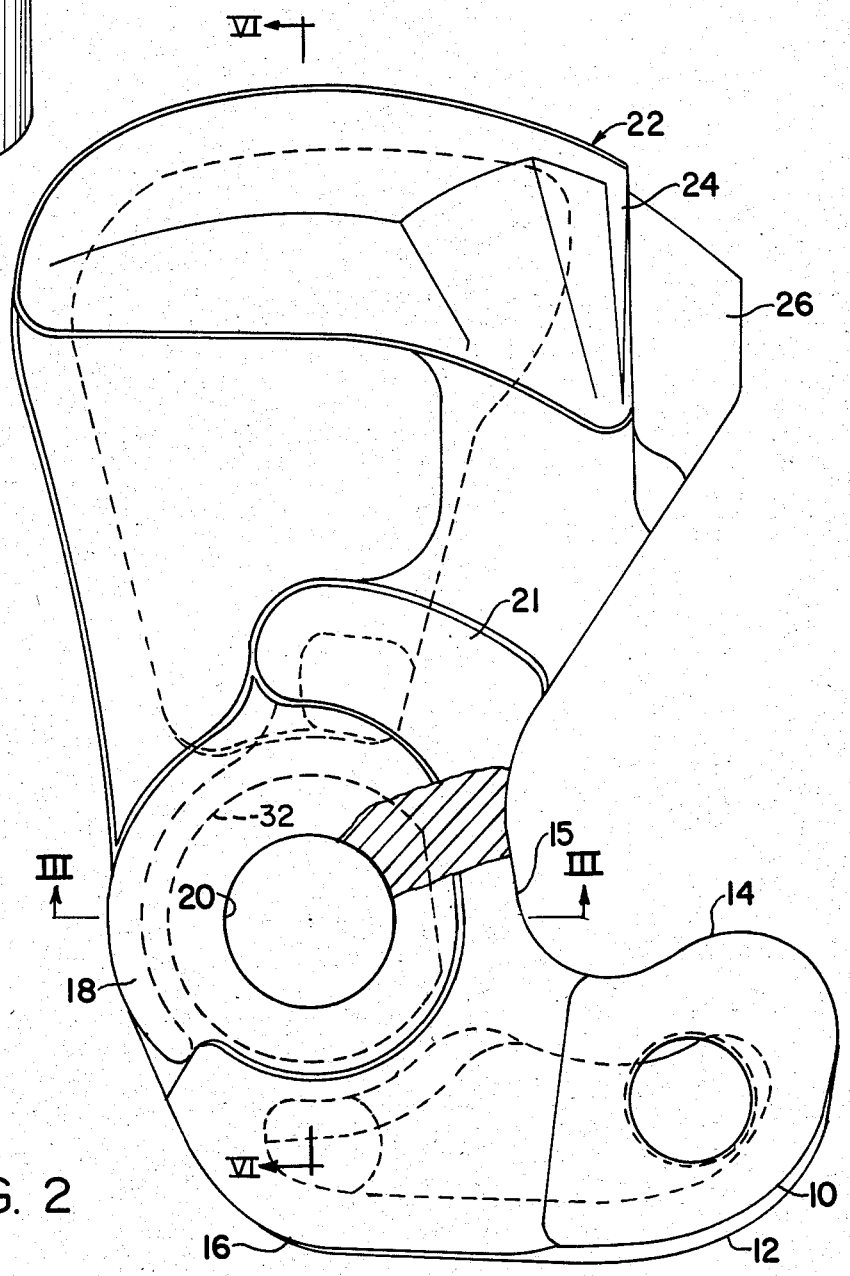
FIG. 2 is a top view of the knuckle shown in FIG. 1.

With reference now to the drawings, and particularly to FIGS. 1 and 2, the coupler shown includes a nose portion 10 having a front face 12 and a pulling face 14. Contiguous with the pulling face 14 is a throat 15; and contiguous with the front face 12 is a heel 16 which joins with a hub 18 provided with a pivot pin hole 20. Behind the hub portion 18 is a buffing shoulder 21 to which is joined an assembly including a tail portion 22 provided with a locking face 24 and a lock shelf 26 which abut against a coupler lock in accordance with conventional practice. The entire knuckle is formed as a single, integral casting.

Figure 3:
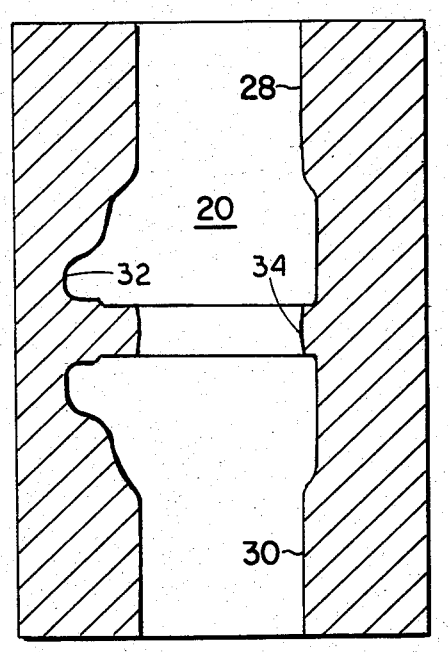
FIG. 3 is a cross-sectional view taken substantially along line III—III of FIG. 2 showing the internal shape of the pivot pin hole of the knuckle.

In FIG. 3, the cross section of the pivot pin hole 20 is shown; and it will be noted that it includes upper and lower circular openings 28 and 30 separated by an intermediate cavity 32 of larger cross-sectional area. As is best shown in FIG. 2, the cavity 32 is generally circular in configuration, but has a projecting annular wall 34 located about centrally between openings 28 and 30. The knuckle is formed in a casting process and the diameter of the opening surrounded by the annular wall is not larger than the diameter of openings 28 and 30 so that deflection of a knuckle pin is restrained by the wall 34. Wall 34 can be conveniently formed by suitable modifications to the core used in a sand mold to form cavity 32 as well as openings 28 and 30. Since openings 28 and 30 are usually cast and sometimes reamed to a desired size for receiving the knuckle pin, the drilling and reaming, if used, can be extended to include such machining of the opening surrounded by wall 34.

Figure 4:
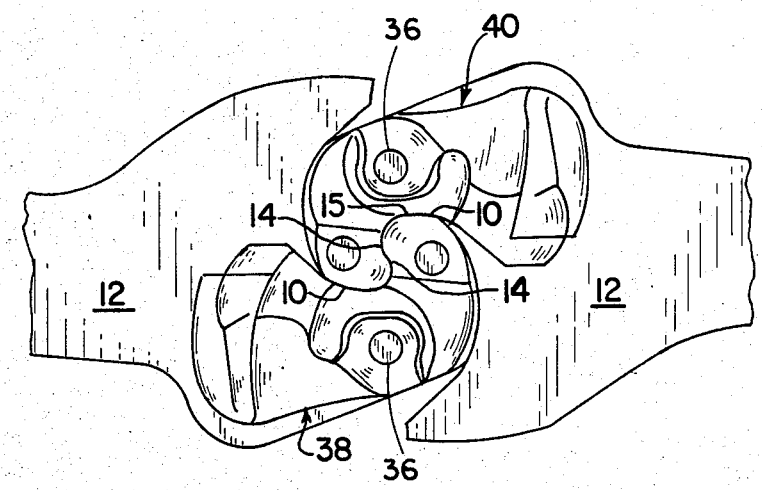
FIG. 4 is a top view illustrating the manner in which knuckles on adjacent couplers interlock.

In FIG. 4, two interlocked knuckles 38 and 40 are shown wherein their pulling faces 14 are in contact with each other. This is a condition which exists when one car in a train is pulling a car behind it. However, when the direction of the train has reversed and one car pushes another, the nose portion 10 of each knuckle 38 and 40 will initially slam against the surface of the throat portion of the adjacent knuckle and since the knuckles are attached to the respective coupler by pins 36, the forces on the knuckles are transmitted partly by the knuckle pins to the couplers. Repeated slamming of one part against the other in this manner produces metal fatigue of the pin and eventually the pin may break. Most broken pins clearly evidence failure because of a fatigue fracture.

It is common practice to construct the knuckle and pin so that each of the openings 28 and 30 is 1/32 of an inch larger than the diameter of the knuckle pin. Since the pin has a straight wall along its length, it is satisfactory according to the present invention to provide that the diameter of the opening in wall 34 is 1/32 of an inch larger than the diameter of the pin. This will reduce the deflection angle of the pin from about 0.9° to 0.437° or about 0.5°. This prevents damage to the pin material by reducing bending of the pin that caused fatigue fracture and abrupt failure of the pin. In all couplers with AAR-type heads, the knuckle pin may be subjected to a load such that a bending moment is created and causes bending of the pin with maximum deflection at its midpoint. Calculations demonstrate that the pin will fail when subjected to a load causing a pin deflection angle of about 0.9°. In accordance with the present invention, bending of the pin under load is limited by the wall 34 to a deflection angle of approximately 0.5° and reduces the bending moment at the locations of pin failure. Since the stress magnitude of the pin is reduced, the likelihood of fatigue fracture is greatly reduced.

In accordance with the present invention, as explained above, metal fatigue is greatly reduced by providing a support wall for the pin between surfaces 28 and 30. A metal-to-metal or zero clearance between the knuckle pin and wall 34 will greatly reduce damaging due to bending moments on the pin.

Figure 5:
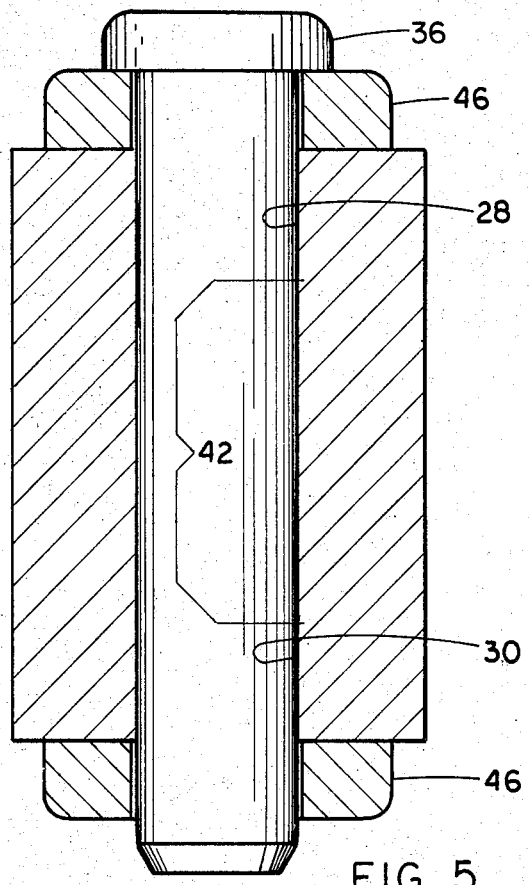
FIG. 5 is a sectional view similar to FIG. 3 and illustrating a second embodiment of the present invention.

A further embodiment of the present invention is illustrated in FIG. 5 wherein the knuckle pin opening along its entire height in the knuckle is formed by a wall section 42 which is a continuation of surfaces 28 and 30. In FIG. 5, the knuckle pin 36 is illustrated which includes a head portion and a constant diameter shank portion extending along a wall surface 28, wall section 42 and wall surface 30. An end portion of the pin extends from the bottom of the knuckle. A hole in the lower end of the knuckle pin is usually provided to receive a cotter for retaining the knuckle pin in the knuckle. As can also be seen from FIG. 5, between the top and bottom ends of the knuckle, pivot pin protectors 46 of the coupler head are provided with openings by which the knuckle is joined to the coupler head by the knuckle pin. Wall section 42 provides a continuous support surface to limit deflecting the shank portion of pin 36 in a direction which is transverse to the length thereof. This inhibits against the inception of an initial fatigue fissure usually occurring in the side wall of the pin which is normally surrounded by surface 28 and sometimes by surface 30. A fatigue fissure brings about an abrupt fracture of the pin under a load in bending.

Figure 6:
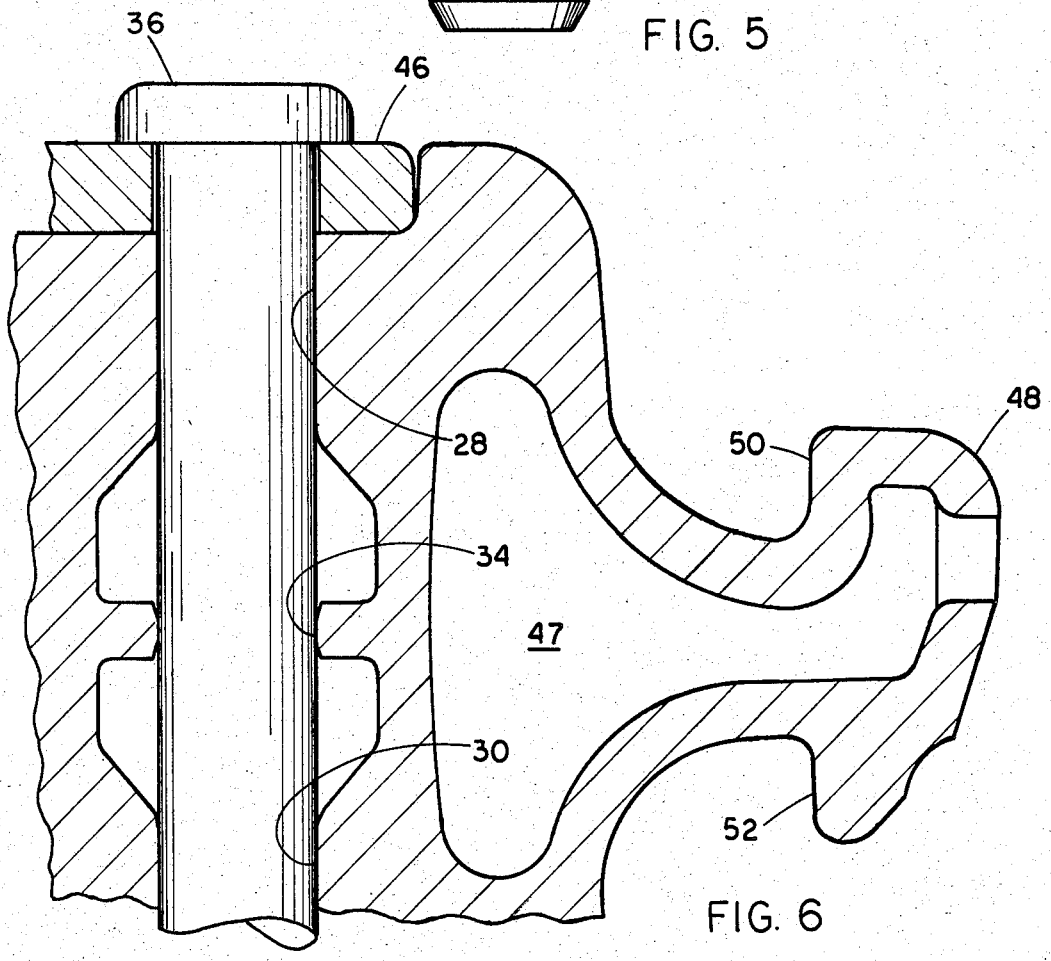
FIG. 6 is a sectional view taken along line VI—VI of FIG. 2 and illustrating the pin in the pin hole of the knuckle and pin support lugs of the coupler head.

FIG. 6 illustrates in greater detail a central core area 47 in the knuckle which extends from an inside surface of the wall forming the support surfaces for a knuckle pin and radially thereof to a knuckle tail 48 having top and bottom lugs 50 and 52, respectively. The lugs are defined by a radius about the center of the pivot pin 36. The height of surface 34 shown in FIG. 6 can be small, e.g., ⅛ of an inch, in relation to the height of surfaces 28 and 30.

Although the invention has been shown in connection with certain specific embodiments, it will be readily apparent to those skilled in the art that various changes in form and arrangement of parts may be made to suite requirements without departing from the spirit and scope of the invention.

I claim as my invention:

1. In a knuckle for a railway coupler of the type having a hub portion provided with a pivot pin hole and bounded on one side by a throat portion contiguous with a nose portion, the nose portion being adapted to be engaged by the nose portion of the knuckle of a cooperating coupler, and wherein said pivot hole is formed in a casting by upper and lower circular openings separated by an intermediate cavity; the improvement in said knuckle comprising an annular knuckle pin support surface in said intermediate cavity, said annular support surface having a diameter essentially corresponding to the diameter of said upper and lower circular openings for supporting a knuckle pin against bending between said upper and lower circular openings whereby bending stresses on the knuckle pin imposed by the nose portion of the knuckle of a cooperating coupler are materially reduced.

2. The improvement according to claim 1 wherein the diameter of said annular knuckle pin support surface is at most 1/32 of an inch greater than the diameter of the knuckle pin.

3. The improvement of claim 1 wherein the annular knuckle pin support surface has a height of at least about $\frac{1}{8}$ of an inch.

4. The improvement of claim 1 wherein the annular knuckle pin support surface in said cavity is continuous between said upper and lower circular openings.

5. The improvement according to claim 1 wherein said annular knuckle pin support surface is dimensioned to engage a knuckle pin in a metal-to-metal relationship.

6. The improvement according to claim 5 wherein said upper and lower circular openings are dimensioned to engage a knuckle pin in a metal-to-metal relationship.

* * * * *